US007418804B2

(12) United States Patent
Tokuno et al.

(10) Patent No.: US 7,418,804 B2
(45) Date of Patent: Sep. 2, 2008

(54) FLOOR STRUCTURE

(75) Inventors: Mitsuhiro Tokuno, Ishikawa-ken (JP); Kazutoshi Tsuda, Ishikawa-ken (JP); Fumihiro Saito, Ishikawa-ken (JP)

(73) Assignees: Asahi Engineering Co., Ltd., Ishikawa-ken (JP); ECO Japan Co., Ltd., Ishikawaken (JP)

( * ) Notice: Subject to any disclaimer, the term of this patent is extended or adjusted under 35 U.S.C. 154(b) by 0 days.

(21) Appl. No.: 11/785,189

(22) Filed: Apr. 16, 2007

(65) Prior Publication Data

US 2007/0193161 A1 Aug. 23, 2007

Related U.S. Application Data

(62) Division of application No. 10/854,186, filed on May 27, 2004, now Pat. No. 7,373,760.

(51) Int. Cl.
*E04C 5/08* (2006.01)
*E04C 2/42* (2006.01)
*E04D 19/12* (2006.01)

(52) U.S. Cl. ..... 52/223.7; 52/223.11; 52/669; 52/666; 14/73; 14/74.5

(58) Field of Classification Search ..... 14/73, 14/74.5; 52/223.7, 223.9, 223.11, 666, 223.6, 52/223.8, 664, 665, 667, 668, 669; 404/36, 404/43; 15/215, 238; 119/527, 529
See application file for complete search history.

(56) References Cited

U.S. PATENT DOCUMENTS 175,028 A * 3/1876 Buzby ..... 104/119
420,731 A * 2/1890 Pajeau ..... 52/100
495,634 A * 4/1893 Johnson ..... 52/778
846,291 A * 3/1907 Emerson ..... 52/663
1,321,213 A * 11/1919 Johnson ..... 52/666
1,807,715 A 6/1931 Tucker
2,078,117 A * 4/1937 Auryansen ..... 52/780
2,112,949 A 4/1938 Bunker
2,878,904 A 3/1959 Percival
3,956,788 A * 5/1976 Nagin ..... 14/73
4,001,988 A * 1/1977 Riefler ..... 52/125.2
4,042,991 A 8/1977 Macy et al.

(Continued)

FOREIGN PATENT DOCUMENTS

FR 777125 2/1935

(Continued)

*Primary Examiner*—Robert Canfield
*Assistant Examiner*—Christine T Cajilig
(74) *Attorney, Agent, or Firm*—Wenderoth, Lind & Ponack, L.L.P.

(57) ABSTRACT

A floor structure comprises a plurality of steel beams 4 arranged in parallel, each steel beam 4 including a web, an upper flange disposed at an upper end of the web, and a lower flange disposed at a lower end of the web, a floor surface being formed on the upper flange 2. The floor structure further includes displacement preventing spacers interposed between the upper flanges and/or lower flanges of the adjacent steel beams. Each displacement preventing spacer includes a load receiving part which is brought into engagement with the adjacent upper flanges and/or lower flanges to receive an active load incurred by the individual steel beams 4 so as to inhibit the steel beams 4 from displacing downward.

9 Claims, 9 Drawing Sheets

U.S. PATENT DOCUMENTS

| | | | | | |
|---|---|---|---|---|---|
| 4,102,100 | A | * | 7/1978 | Perreten | 52/223.7 |
| 4,952,434 | A | * | 8/1990 | Rumsey et al. | 428/54 |
| 5,660,906 | A | * | 8/1997 | Hill | 428/53 |
| 5,937,588 | A | * | 8/1999 | Gard | 52/79.1 |
| 6,049,932 | A | * | 4/2000 | Mangone | 14/73 |

FOREIGN PATENT DOCUMENTS

| | | |
|---|---|---|
| JP | 37-14844 | 6/1962 |
| JP | 48-50534 | 7/1973 |
| JP | 51-101024 | 2/1976 |
| JP | 51-21532 | 6/1976 |
| JP | 57-137509 | 8/1982 |
| JP | 8-253912 | 10/1996 |
| WO | 01/31142 | 5/2001 |

* cited by examiner

FLOOR STRUCTURE

This application is a divisional application of application Ser. No. 10/854,186, filed May 27, 2004 now U.S. Pat. No. 7,373,760.

BACKGROUND OF THE INVENTION

1. Field of the Invention

The present invention relates to a floor structure such as a floor plate bridge structure built on a river or land, a slab structure of respective hierarchies such as a steel frame building and an iron reinforced concrete building, a roadbed structure formed on an upper surface of an underground construction, a roadbed structure laid on a ground surface, or the like.

2. Related Art

Patent Document 1 shows a bridge structure, in which steel beams each consisting of an upper flange, a lower flange and a web are arranged in parallel, an iron reinforcement is arranged and concrete is placed between the adjacent steel stocks, i.e., in a space defined by upper and lower flanges of the adjacent steel beams and the web, and the iron reinforced concrete and the web are tightly connected to each other by a PC steel beam piercing the iron reinforced concrete and the web in the width direction of the bridge.

The above bridge structure is based on such a designing idea that the bridge strength against an active load such as vehicles is borne by an iron reinforced concrete placed between the adjacent steel stocks (i.e., steel beams).

Moreover, the slab structure of the respective hierarchies of the conventional steel frame building is formed by supporting a floor plate by beam members, and the slab structure of the respective hierarchies of the iron reinforced concrete building is normally formed with a monolithically placed concrete. Likewise, the roadbed structure temporarily laid on the upper surface of an underground construction employs a method in which iron plates are supported by beam members, and the construction site where trucks and heavy machines frequently come in and out, typically employs a method in which iron plates are merely laid on a ground surface to form a temporary roadbed.

It should be noted that the "Patent Document 1" mentioned above refers to Official Gazette of Japanese Patent Application Laid-Open No. H08-253912

Problems To Be Solved By The Invention

However, the bridge shown in the above-mentioned Patent Document 1 is a structure in which the integration is achieved by the steel beams and the iron reinforced concrete placed at the site, and no consideration is given at all to a unit structure in which the steel beams are dismantled one by one and re-used.

Therefore, the conventional technique is not suited as a floor structure of a temporarily built bridge and the like. At the time of rebuilding, a large scale dismantling operation and a large amount of dismantling expense are required. Moreover, a great deal of scrap is produced thereby impairing the environment. In addition, the form assembling process, the bar arranging process and the concrete placing process are required, thus resulting in increased construction cost.

On the other hand, in the above-mentioned roadbed structure, many heavy iron plates are required to be laid or recovered, a step and a gap are formed between the adjacent iron plates, and substantial walking noises are generated. Thus, the conventional structure has problems as the original floor structure in view of strength and appearance.

Moreover, in case a slab is formed by integral placement of concrete in a concrete building, a complicated form assembling process is required, and much time and labor is required for installation and removal of many jacks. When it is taken into consideration that there is an additional need for concrete curing, etc., the period required for the total construction process is increased and the total construction cost is increased, too.

Furthermore, it is customary in a steel frame building that the load is supported by a joist which is horizontally disposed between a floor plate and a beam member. However, deflection and creaking are liable to occur. Moreover, much time and labor is required for constructing a joist, a floor plate and a ceiling plate.

SUMMARY OF THE INVENTION

Object of the Invention

It is, therefore, an object of the present invention to provide, a bridge floor structure in a floor plate bridge, a floor structure in a steel frame building, a floor structure in an iron reinforced building, a floor structure on an upper surface of an underground construction, and a floor structure laid on a ground surface, which are capable of solving the above-mentioned problems.

Means For Solving The Problems

A floor structure according to the present invention comprises a plurality of steel stocks (i.e., steel beams) arranged in parallel, each steel beam including a web, an upper flange disposed at an upper end of the web, and a lower flange disposed at a lower end of the web. A floor surface is formed on the upper flange. The floor structure further comprises a displacement preventing spacer interposed between the upper flanges and/or lower flanges of each adjacent pair of steel beams. The displacement preventing spacer includes a load receiving part which is brought into engagement with the adjacent upper flanges and/or lower flanges to receive an active load incurred by the individual steel beams so as to inhibit the steel beams from displacing downward.

As one embodiment thereof, the floor structure further comprises a displacement preventing spacer, the displacement preventing spacer including a left fitting part fitted between the upper and lower flanges of each adjacent left side steel beam, a right fitting part fitted between the upper and lower flanges of each adjacent right side steel beam, an upper interposing part interposed between the upper flanges of the adjacent steel beams, and a lower interposing part interposed between the adjacent lower flanges.

Left side upper and lower step parts formed at an interlocking part between the upper and lower interposing parts and the left fitting part are engaged with a lower surface of the upper flange and an upper surface of the lower flange of the left side steel beam, right side upper and lower step parts formed at an interlocking part between the upper and lower interposing parts and the right fitting part being engaged with a lower surface of the upper flange and an upper surface of the lower flange of the right side steel beam. Owing to those engagements, the individual steel beams are inhibited from being displaced downward.

As another embodiment, in the floor structure using the H-shaped steel beams, the floor structure further comprises a left displacement preventing block fitted to a space defined between the upper and lower flanges and the web of each adjacent left side steel beam, and a right displacement preventing block fitted to a space defined between the upper and lower flanges and the web of each adjacent right side steel beam, mutually opposing side surfaces of the left and right displacement preventing blocks being press butted between the adjacent steel beams, the individual steel beams being inhibited from displacing downward due to a surface pressure and a friction engagement between the press butted surfaces.

As a further embodiment, in the floor structure using the H-shaped steel beams, the floor structure further comprises a left displacement preventing block fitted to a space defined between the upper and lower flanges and the web of each adjacent left side steel beams, and a right displacement preventing block fitted to a space defined between the upper and lower flanges and the web of each adjacent right side steel beam, mutually opposing side surfaces of the left and right displacement preventing blocks being press butted between the adjacent steel beams, a mutually engaging concave and convex part or a step part being formed on the two press butted surfaces, thereby inhibiting the individual steel beams from being displaced downward.

Preferably, the left and right displacement preventing blocks are formed of a wood, or lightweight cellular concrete or rigid foamed resin.

The floor structure is effective to prevent displacement due to an active load when a floor structure is formed by arranging steel beams in parallel. The displacement preventing spacer is preliminarily prepared, and the displacement preventing spacer is fitted between the steel beams which are arranged in parallel. By doing so, the individual steel beams are effectively prevented from being displaced downward against the active load.

Likewise, the preliminarily prepared left and right displacement preventing blocks are fitted to each steel beam, and two such blocks are merely press butted with each other while arranging the steel beams in parallel. By doing so, the vertical displacement preventing effect can properly be obtained against the active load.

In any of the above cases, the floor structure can easily be assembled using steel beams, and cost reduction can be achieved.

Moreover, in any of the above cases, the floor structure can be made into a unit structure, and dismantling and re-use are possible.

DETAILED DESCRIPTION OF THE EMBODIMENTS

Figure 1:
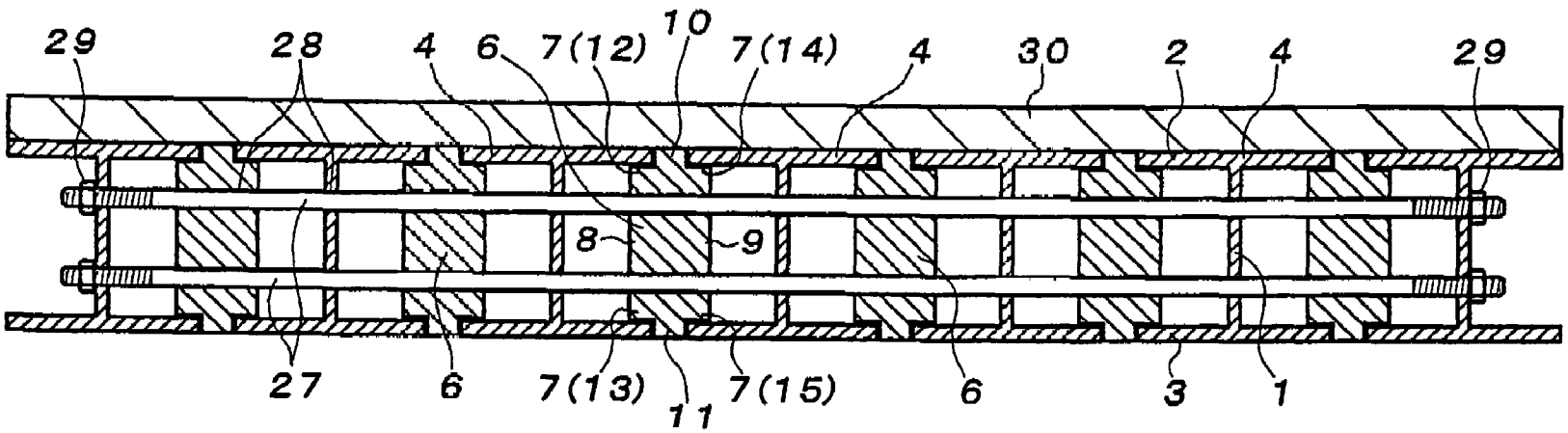
FIG. 1 is a sectional view of a floor structure showing a first embodiment using a displacement preventing spacer.

Embodiments of a floor structure according to the present invention will be described hereinafter with reference to FIGS. 1 through 10(B).

The floor structures shown in FIGS. 1 through 10(B) show a bridge floor structure in a floor plate bridge, a floor structure in a steel frame building and an iron reinforced concrete building, a floor structure of an upper surface of an underground construction, and a floor structure laid on a ground surface, in which a plurality of steel stocks (i.e., steel beams) 4 each having an upper flange 2 at the upper end of a web 1 and a lower flange 3 at the lower end are arranged in parallel, and a floor surface is formed on the upper flange 2.

The steel beams 4 are obtained by welding the upper flange 2, which bulges out symmetrically in the left and right direction, to the upper end of the web 1 and welding the lower flange 3, which bulges out symmetrically in the left and right direction, to the lower end of the web 1, so that the resultant steel beam 4 exhibits an H-shape. Preferably, a general purpose H-steel (i.e., H-shaped steel beam) as specified in Japan Industrial Standards is employed as the steel stock.

In case the floor structure is a floor plate bridge, the opposite ends of the steel beams 4 (floor structure), i.e., the opposite ends of the lower flanges 3 are supported between piers 5 in a suspending manner. In this case, the steel beam 4 constitutes a main girder.

In the case of a building, the opposite ends of the steel beams 4 (floor structure), i.e., the opposite ends of the lower flanges 3, are supported between vertical walls in a suspending manner to thereby form a slab of respective hierarchies. In the case of a roadbed formed on a ground surface, the steel beams 4 (floor structure) are laid on a ground surface through the lower flanges 3. Also, the steel beams (floor structure) are laid on a scaffolding constructed in an underground space through the lower flanges 3, and the floor surface is formed on the upper flanges 2 in each exemplified case.

As a common structure shown in FIGS. 1 through 4, in the floor structure, displacement preventing spacers 6 are interposed between the upper flanges 2 and/or the lower flanges 3 of the adjacent steel beams, a load receiving part 7 of each displacement preventing spacer 6 is brought into engagement with the adjacent upper flanges 2 and/or the adjacent lower flanges 3 to receive an active load incurred by the individual steel beams 4 so as to inhibit the individual steel beams 4 from displacing downward. That is, the active load incurred by the individual steel beams 4 is incurred by the adjacent steel beams 4 through the displacement preventing spacers 6 such that the load is incurred by the entire structure and dispersed.

As its first embodiment, as shown in FIG. 1, the floor structure further comprises displacement preventing spacers 6 interposed between the upper flanges 2 and the lower flanges 3 of the adjacent steel beams 4. Each of the displacement preventing spacers 6 includes a left fitting part 8 fitted between the upper and lower flanges 2, 3 of the adjacent left side steel beam 4, a right fitting part 9 fitted between the upper and lower flanges 2, 3 of the adjacent right side steel beam 4, an upper interposing part 10 interposed between the upper flanges 2 of the adjacent steel beams 4, and a lower interposing part 11 interposed between the adjacent lower flanges 3.

A left side upper step part 12 formed at an interlocking part between the upper interposing part 10 and the left fitting part 8 is engaged with a lower surface of the upper flange 2 of the left side steel beam 4 and a left side lower step part 13 formed at an interlocking part between the upper interposing part 10 and the left fitting part 8 is engaged with an upper surface of the lower flange 3 of the left side steel beam 4.

At the same time, a right side upper step part 14 formed at an interlocking part between the upper interposing part 10 and the right fitting part 9 is engaged with a lower surface of the upper flange 2 of the right side steel beam 4, and a right side lower step part 15 formed at an interlocking part between the upper interposing part 10 and the right fitting part 9 is engaged with an upper surface of the lower flange 3 of the right side steel beam 4. Owing to these engagements, the individual steel beams 4 are inhibited from being displaced downward.

Figure 2:
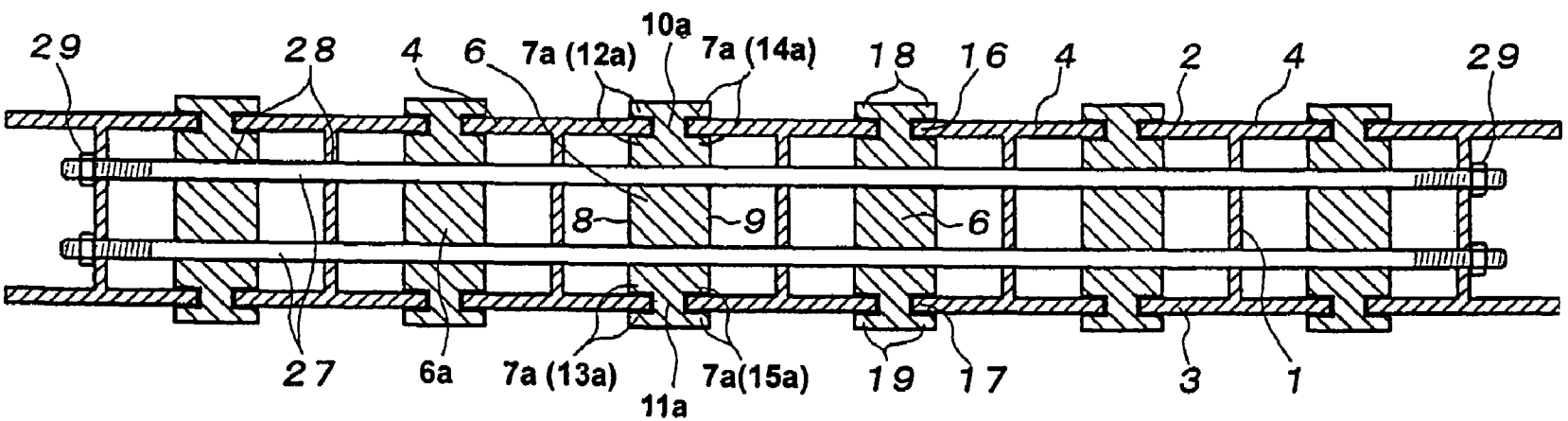
FIG. 2 is a sectional view of a floor structure showing a second embodiment using a displacement preventing spacer.

As a second embodiment, as shown in FIG. 2, the displacement preventing spacer 6*a* is provided at an upper end of the upper interposing part 10*a* with an upper engagement part 18 which is engaged with upper surfaces of the upper flanges 2 of the adjacent steel beams 4, and the displacement preventing spacer 6*a* is provided at a lower end of the lower interposing part 11*a* with a lower engagement part 19 which is engaged with lower surfaces of the lower flanges 3 of the adjacent steel beams 4.

That is, the displacement preventing spacer 6*a* is provided at the left and right of the upper interposing part 10*a* with upper engagement grooves 16. The upper flanges 2 of the adjacent steel beams 4 are brought into engagement with the left and right upper engagement grooves 16, thereby restraining the upper flanges 2. Thus, the load receiving part 7*a* is formed by the pair of upper step parts 12*a*, 14*a* which define the left and right upper engagement grooves 16.

Likewise, the displacement preventing spacer 6*a* is provided at the left and right of the lower interposing part 11*a* with lower engagement grooves 17. The lower flanges 3 of the adjacent steel beams 4 are brought into engagement with the left and right lower engagement grooves 17, thereby restraining the lower flanges 3. Thus, the load receiving part 7*a* is formed by the pair of upper step parts 13*a*, 15*a* which define the left and right lower engagement grooves 17.

Figure 3:
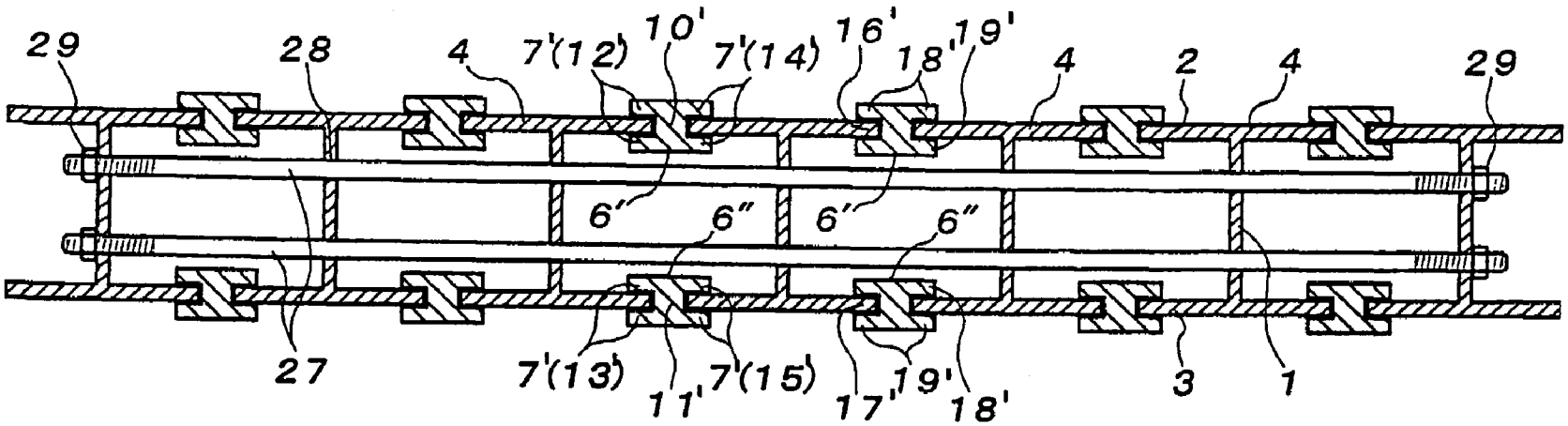
FIG. 3 is a sectional view of a floor structure showing a third embodiment using a displacement preventing spacer.

As a third embodiment, as shown in FIG. 3, each displacement preventing spacer is separated into an upper displacement preventing spacer 6' interposed between the upper flanges 2 of the adjacent steel beams 4, and a lower displacement preventing spacer 6" interposed between the lower flanges 3 of the adjacent steel beams 4 (namely, the spacer is formed of separate members). The load receiving parts 7' of the respective displacement preventing spacers 6', 6" are brought into engagement with the adjacent upper flanges 2 and the adjacent lower flanges 3 to receive the active load incurred by the individual steel beams 4, so that the individual steel beams 4 are inhibited from displacing downward. That is, the load incurred by the individual steel beams 4 is incurred by the adjacent steel beams 4 through the displacement spacers 6', 6" and the load is dispersed to the entire structure.

More specifically, as shown in FIG. 3, upper engagement grooves 16' are formed at the left and right parts of the upper interposing part 10' of the upper displacement preventing spacer 6', and the upper flanges 2 of the adjacent steel beams 4 are brought into engagement with the engagement grooves 16', respectively. Thus, the load receiving part 7' is formed by the pair of upper step parts 12', 14' which define the left and right upper engagement grooves 16'.

That is, the upper engagement parts 18' which define the upper engagement grooves 16' of the upper displacement spacer 6' are brought into engagement with the upper surfaces of the upper flanges 2 of the adjacent steel beams 4, and the lower engagement parts 19' are likewise brought into engagement with the lower surfaces of the upper flanges 2 of the adjacent steel beams 4, respectively, and the load receiving part 7' against the active load is formed by the step parts 12', 14' formed at the interlocking part between the upper engagement part 18' forming the upper engagement groove 16' and the upper interposing part 10', and the step parts 12', 14' formed at the interlocking part between the lower engagement part 19' and the upper interposing part 10', so that the individual steel beams 4 are inhibited from displacing downward.

Likewise, upper engagement grooves 17' are formed at the left and right parts of the lower interposing part 11' of the lower displacement preventing spacer 6", and the lower flanges 3 of the adjacent steel beams 4 are brought into engagement with the engagement grooves 17', respectively. Thus, the load receiving part 7' is formed by the pair of upper step parts 13', 15' which define the left and right lower engagement grooves 17'.

That is, the upper engagement parts 18' which define the lower engagement grooves 17' of the lower displacement spacer 6" are brought into engagement with the upper surfaces of the lower flanges 3 of the adjacent steel beams 4, and the lower engagement parts 19' are likewise brought into engagement with the lower surfaces of the lower flanges 3 of the adjacent steel beams 4, respectively, and the load receiving part 7' against the active load is formed by the step parts 13', 15' formed at the interlocking part between the upper engagement part 18' forming the lower engagement groove 17' and the lower interposing part 11', and the step parts 13', 15' formed at the interlocking part between the lower engagement part 19' and the lower interposing part 10', so that the individual steel beams 4 are inhibited from displacing downward.

Figure 4:
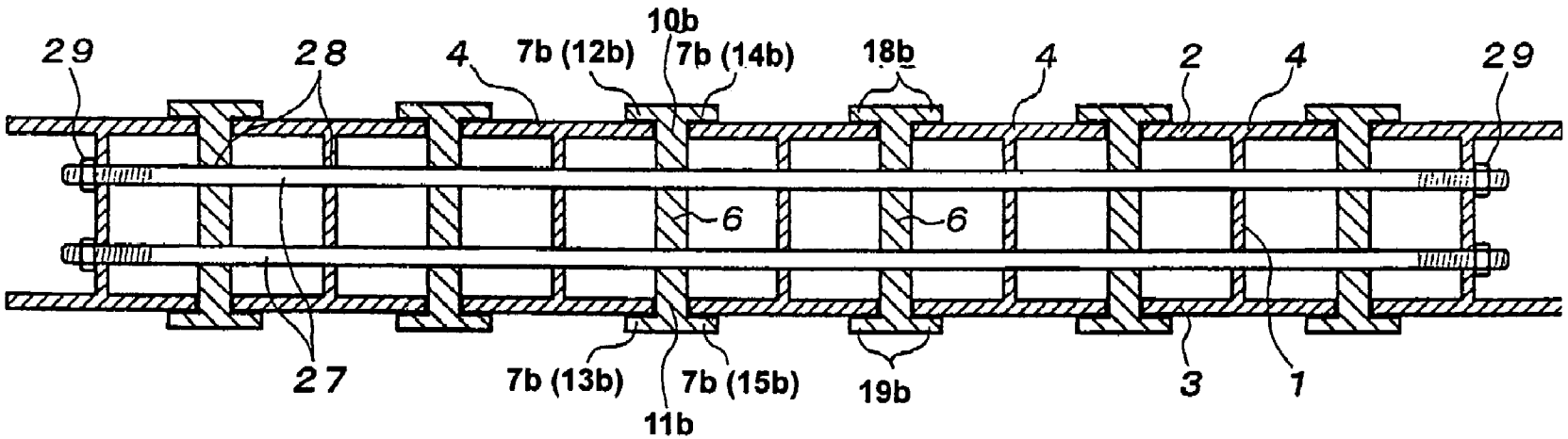
FIG. 4 is a sectional view of a floor structure showing a fourth embodiment using a displacement preventing spacer.

As a fourth embodiment, as shown in FIG. 4, a displacement preventing spacer 6*b* is interposed between the adjacent steel beams 4. The displacement preventing spacer 6*b* includes an upper interposing part 10 interposed between the upper flanges 2 of the adjacent steel beams 4, and a lower interposing part 11*b* interposed between the adjacent lower flanges 3 of the adjacent steel beams 4. The displacement preventing spacer 6*b* is provided at an upper end thereof with an upper engagement part 18*b* which is engaged with the upper surfaces of the upper flanges 2 of the adjacent steel beams 4, and the displacement preventing spacer 6*b* is provided at a lower end thereof with a lower engagement part 19*b* which is engaged with the lower surfaces of the lower flanges 3 of the adjacent steel beams 4.

Thus, the load receiving part 7*b* is formed by the step parts 12*b*, 14*b* which are formed at the interlocking part between the upper interposing part 10*b* and the upper engagement part 18*b*, and the load receiving part 7*b* is formed by the step parts 13*b*, 15*b* which are formed at the interlocking part between the lower interposing part 11*b* and the lower engagement part 19*b*.

Owing to the above arrangement, the active load incurred by the individual steel beams 4 is received by the load receiving part 7*b*, so that the individual steel beams 4 are inhibited from displacing downward. That is, the active load incurred by the individual steel beams 4 is incurred by the adjacent steel beams 4 through the spacer 6*b*, and the load is incurred by the entire structure and dispersed.

As other examples, as shown in FIGS. 5 through 8, In a floor structure using the H-shaped steel beams, the floor structure further comprises a left displacement preventing block 20 fitted to a space defined between the upper and lower flanges 2, 3 and the web 1 of each adjacent left side steel beam 4, and a right displacement preventing block 20 fitted to a space defined between the upper and lower flanges 2, 3 and the web 1 of each adjacent right side steel beam 4. That is, each steel stock 4 includes left and right displacement preventing blocks 20.

While the steel beams 4 are arranged in parallel, mutually opposing side surfaces 21 of the left and right displacement preventing blocks 20 are press butted between the adjacent steel beams 4, and the individual steel beams 4 are inhibited from displacing downward due to a surface pressure and a friction engagement between the press butted surfaces 21.

Figure 7:
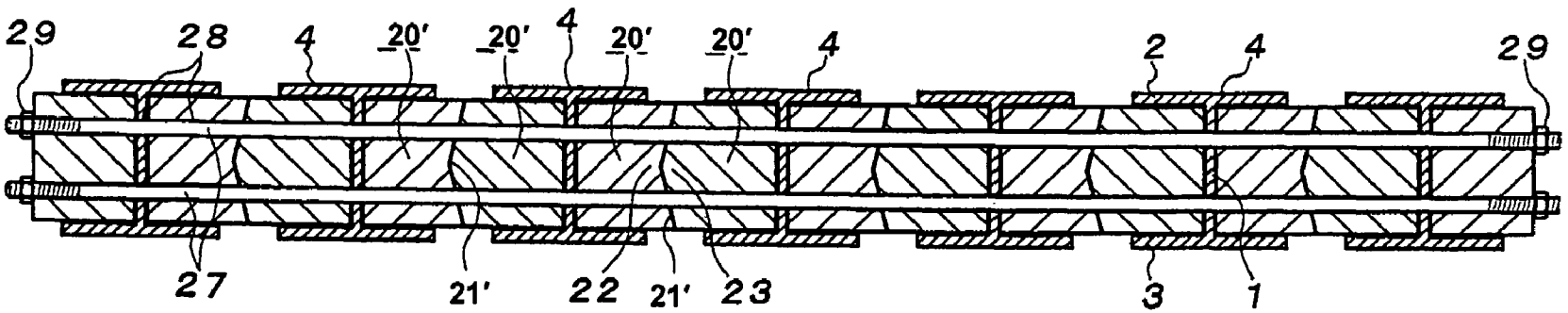
FIG. 7 is a sectional view of a floor structure showing the third embodiment using a displacement preventing block.

Also, as shown in FIG. 7, in a floor structure using the H-shaped steel beams, mutually opposing side surfaces 21' of the left and right displacement preventing blocks 20' are press butted between the adjacent steel stocks 4, and a mutually engaging concave part 22 and convex part 23 or a step part are formed on the two press butted surfaces 21', thereby inhibiting the individual steel beams 4 from being displaced downward.

The left and right displacement preventing blocks 20' are restricted at their upper surface and lower surface by a lower surface of the upper flange 2 and an upper surface of the lower flange 3, respectively, and the side surfaces that oppose the butting surfaces of the left and right displacement preventing blocks 20' are restricted by the side surfaces of the web 1, and in that condition, the left and right displacement preventing blocks 20' are fitted to the left and right sides of the web 1.

Figure 5:
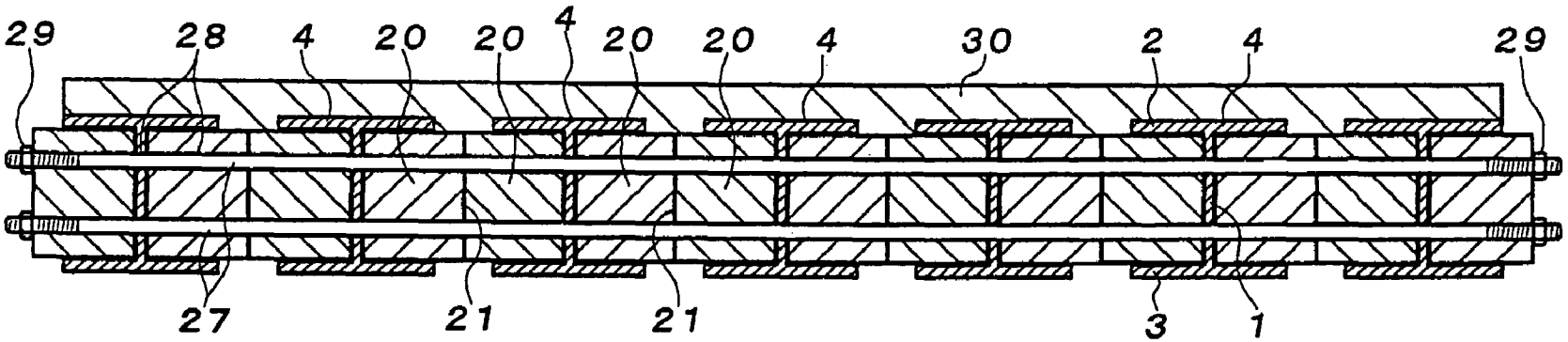
FIG. 5 is a sectional view of a floor structure showing the first embodiment using a displacement preventing block.

In the example shown in FIG. 5, left and right displacement preventing blocks 20 all having the same size are employed. The blocks 20 are fitted to a left side space defined by the upper and lower flanges 2, 3 and the web 1 of each steel beam 4, and they are also each fitted to a right side space defined by the right side upper and lower flanges 2, 3 and the web 1 of each steel beam 4.

Figure 8:
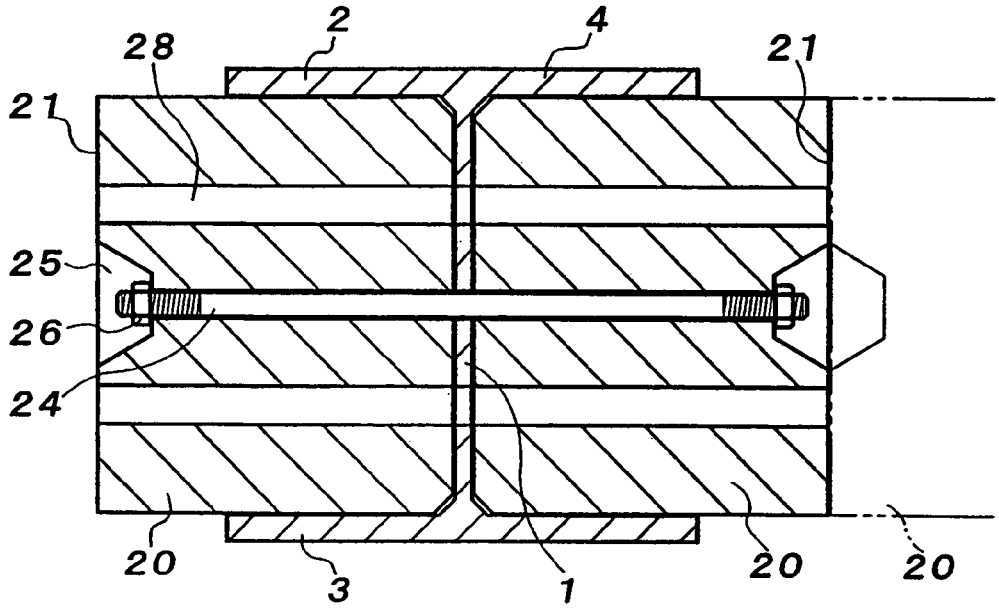
FIG. 8 is a sectional view exemplifying an attachment structure for attaching the displacement preventing block to the steel stock in the above-mentioned respective embodiments.

In the left and right displacement preventing blocks 20, as shown in FIG. 8, a bolt 24 is allowed to pierce into the left and right displacement preventing blocks 20 and opposite ends of the bolt 24 are tightened by nuts 26 in release holes 25 formed in opposing side surfaces 21 of the left and right displacement preventing blocks 20, so that the steel beam 4 and the left and right displacement preventing blocks 20 are integrated.

The steel beams 4 including the left and right displacement preventing blocks 20 are arranged in parallel, such that the displacement preventing blocks 20 are press butted with each other.

In FIG. 5, the displacement preventing blocks 20 having the same size are carried on the respective steel beams 4, and the displacement preventing blocks 20 are allowed to project from the end part of the upper flange 2 or from the end parts of the upper flange 2 and the lower flange 3 so as to be subjected to the butting engagement.

Figure 6:
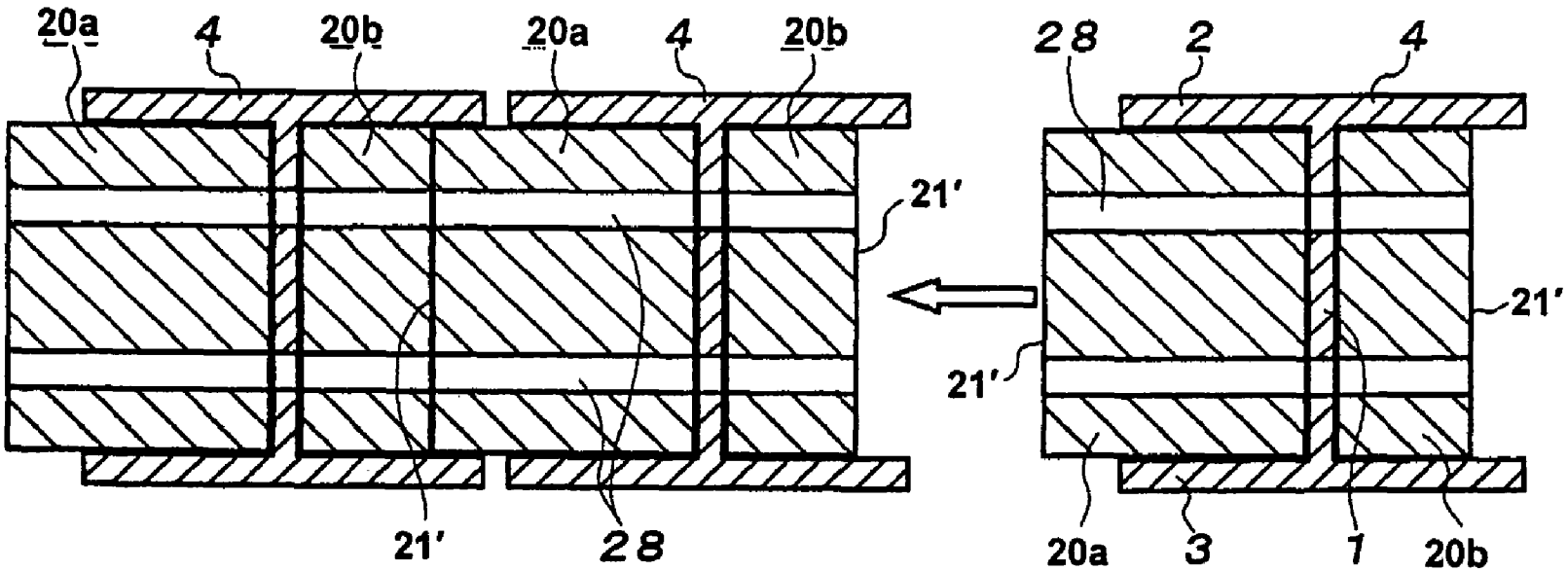
FIG. 6 is a sectional view of a floor structure showing the second embodiment using a displacement preventing block.

On the other hand, in FIG. 6, a displacement preventing block 20*a* is allowed to protrude from an end part of the upper flange 2 or from ends of the upper flange 2 and the lower flange 3 and is fitted to and carried by the space (first space) formed on the left side (or right side) of each steel beam 4, and a protruded part of another displacement preventing block 20*b*, which is adjacent to the above-mentioned block 20*a*, is allowed to sink in the space (second space) formed at the right side (left side) of the steel beam 4 so as to be fitted to and carried by the second space.

Thus, the protruded part of the displacement preventing block 20*a* of one of the adjacent steel beams 4 is fitted into the space of the sink displacement preventing block 20*b* of the other of adjacent steel beams 4, i.e., fitted between the upper and lower flanges 2, 3, while the opposing side surfaces 21' of the two displacement preventing blocks 20*a*, 20*b* are butted with each other. This abutting surface 21' may take the form of a displacement preventing surface under the effect of the press friction engagement as shown in FIG. 5 or the form of a displacement preventing surface under the effect of the concave-and-convex engagement as shown in FIG. 7. Also with these displacement preventing blocks 20*a*, 20*b*, as shown in FIG. 8, the blocks 20*a*, 20*b* are integrated with the steel beams through the bolt 24.

Preferably, the left and right displacement preventing blocks are formed of a wood, or lightweight cellular concrete or rigid foamed resin, so that the blocks can be reduced in weight.

Figure 9A:
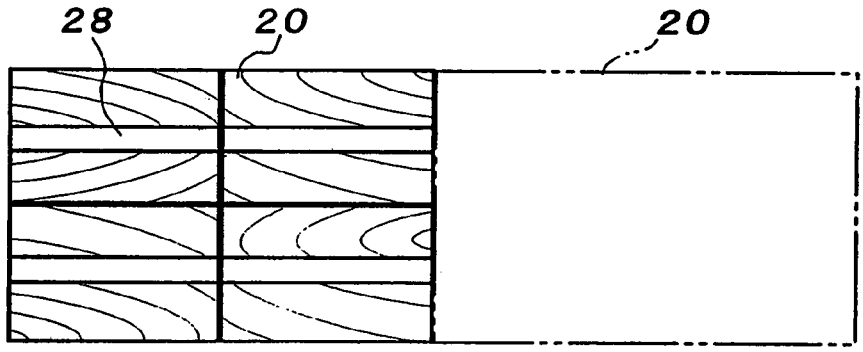
FIG. 9(A) is a sectional view showing an example in which a laminated wood is used as the displacement preventing block.

In the alternative, as shown in FIG. 9(A), a wood, for example, a spotless wood or a laminated wood, for example, quadrate wood columns are laminated to form a quadrate laminated wood member, and the wood members thus obtained are used as the left and right displacement preventing blocks 20.

Figure 9B:
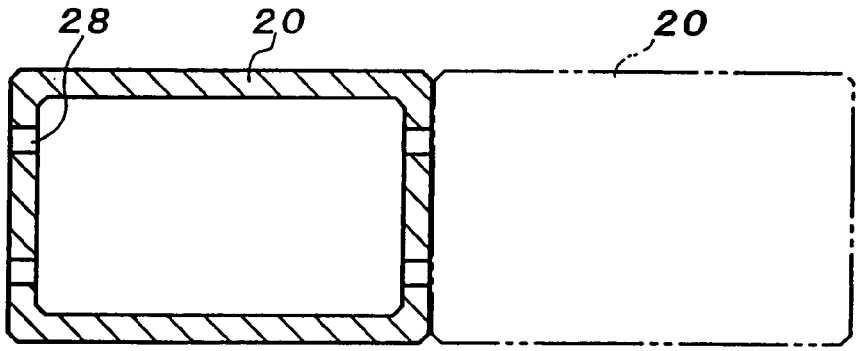
FIG. 9(B) is a sectional view showing another example in which a tube member is used as the displacement preventing block.

In the alternative, the left and right displacement preventing blocks 20, as shown in FIG. 9(B), are composed of a metal tube, for example, a steel tube, a synthetic resin tube, or a concrete tube.

The displacement preventing spacer interposed between the flanges as shown in FIGS. 1 through 4, and the left and right displacement preventing blocks as shown in FIGS. 5 through 9 are integrally tightened with the respective steel beams 4 through a tightening wire rod 27.

That is, each displacement preventing spacer 6 and the web 1 are provided with a through-hole 28 which is communicated in the floor width direction (arranging direction of the steel stocks), and each of the left and right displacement preventing blocks 20 and the web 1 are likewise provided with a through-hole which is communicated in the floor width direction (arranging direction of the steel beams). An elongate tightening wire rod 27 is allowed to extend in the through-hole 28, and nuts 29 are threadingly engaged with the opposite ends of the tightening wire rod 27 and tightened, so that the displacement preventing spacer 6 or the left and right displacement preventing blocks 20 and all of the steel beams 4 are integrally tightened.

The tightening wire rod 27 may be a steel wire or a stainless steel bar.

Thus, the displacement preventing spacer 6 is press tightened between the upper flanges 2 and/or between the lower flanges 3 of every adjacent pair of the steel beams 4 and intimately contacted with the end parts of the flanges 2, 3.

Likewise, the left and right displacement preventing blocks 20 are press tightened with the left and right side surfaces of the web 1 of every adjacent pair of the steel stocks 4 and intimately contacted therewith. At the same time, the opposing side surfaces 21 of the left and right displacement preventing blocks 20 are press butted with each other.

Figure 10A:
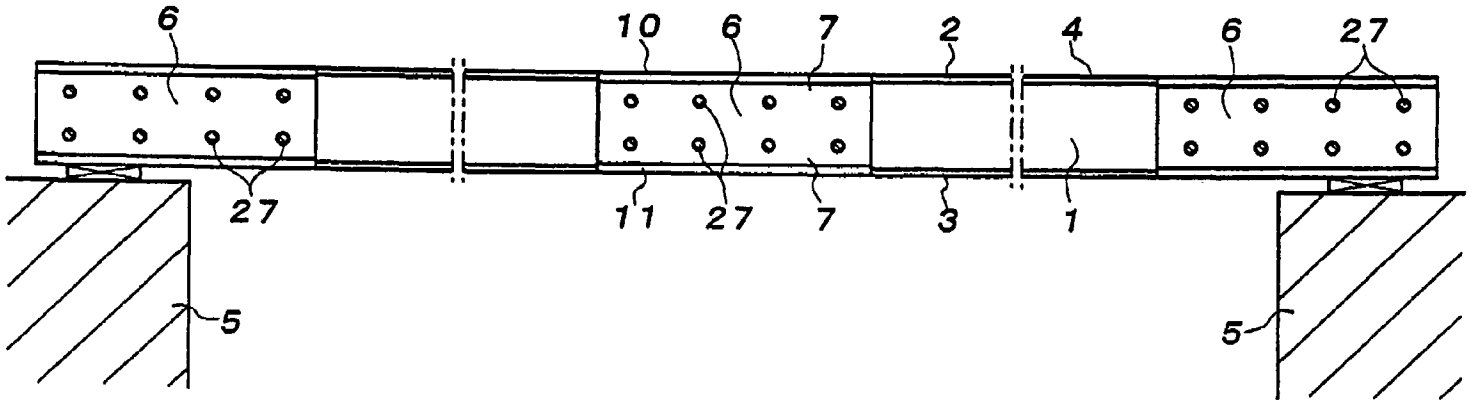
FIG. 10(A) is a side view, in the axial direction of a steel stock, of a floor structure using the above displacement preventing spacer.

As shown in FIG. 10(A), the displacement preventing spacers 6 are spacedly arranged in the axial direction of the steel beams 4, or continuously arranged in a mutually intimately contacted manner in the axial direction of the steel beams 4.

Figure 10B:
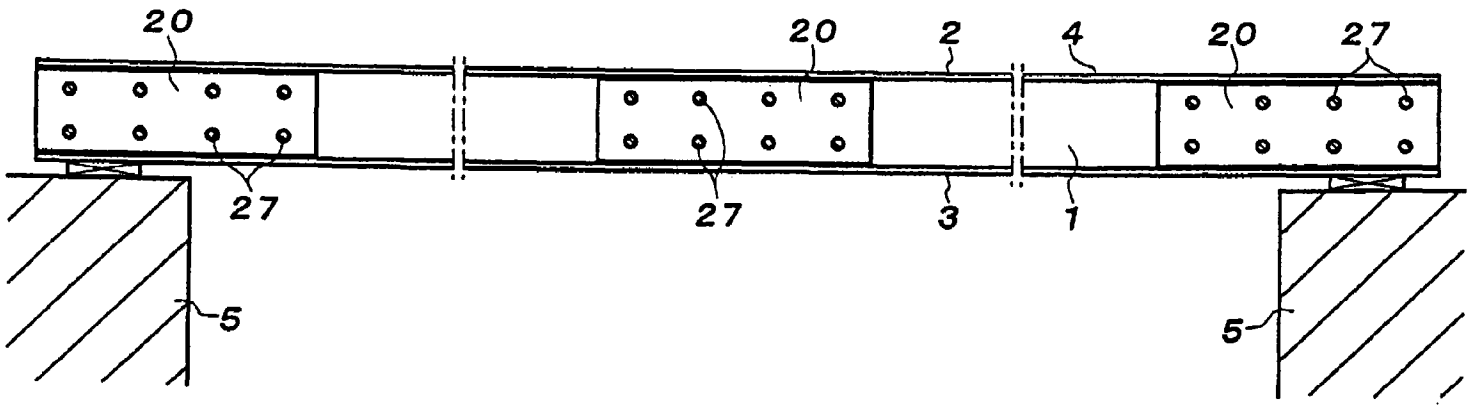
FIG. 10(B) is a side view, in the axial direction of a steel stock, of a floor structure using the above displacement preventing block.

Likewise, as shown in FIG. 10(B), the left and right displacement preventing blocks 20 are spacedly arranged in the axial direction of the steel beams 4, or continuously arranged in a mutually intimately contacted manner in the axial direction of the steel beams 4.

The upper flange 2 and the lower flange 3 of each steel beam 4 used herein may be of a structure mutually bulged out in equal width or a structure in which the upper flange 2 is dimensioned to be short and the lower flange 3 is dimensioned to be long in width.

In the above floor structure, the upper surface of the upper flange 2 of each steel beam 4 is formed directly into a floor surface, or a pavement 30 of concrete or asphalt or the like is applied to the upper surface of the upper flange 2 and its upper surface is formed into a floor surface. In the alternative, a floor assembly can be constructed on the upper flange 2 of the floor structure using a joist and a floor plate, thereby a floor surface can be formed on the upper flange 2.

Effect of the Invention

The present invention is extremely effective in preventing displacement under an active load in which a floor structure is formed by arranging steel beams in parallel. That is, the steel beams are arranged in parallel, and the displacement preventing spacers is fittingly interposed between the steel beams. By doing so, the individual steel beams can effectively be prevented from displacing downward which would otherwise occur due to active loading.

Likewise, the left and right displacement preventing blocks are preliminarily fitted to each steel beam, and such two blocks are arranged in parallel and merely press butted with each other. By doing so, the vertical displacement effect against the active load can properly be obtained.

Also, in any of the above cases, a floor structure can easily be assembled using steel beams, and cost reduction can be achieved.

Moreover, in any of the above cases, the floor structure can be formed into a unit structure, and dismantling and re-use are possible.

What is claimed is:

1. A floor structure comprising:

a plurality of steel beams arranged in parallel, each of said steel beams including a web, an upper flange disposed at an upper end of said web, and a lower flange disposed at a lower end of said web, a floor surface being formed on said upper flanges of said steel beams; and a pair of displacement preventing blocks disposed between each adjacent pair of said steel beams, each pair of said displacement preventing blocks including a left displacement preventing block and a right displacement preventing block;

wherein each of said displacement preventing blocks is constituted by a single, unitary block and has a left side surface and a right side surface;

wherein said each adjacent pair of said steel beams is constituted by a left side steel beam and a right side steel beam;

wherein for said each pair of said displacement preventing blocks disposed between said each adjacent pair of said steel beams, said left displacement preventing block is fitted in a space defined between said upper flange of said left side steel beam, said lower flange of said left side steel beam, said web of said left side steel beam and said right displacement preventing block, and said right displacement preventing block is fitted in a space defined between said upper flange of said right side steel beam, said lower flange of said right side steel beam, said web of said right side steel beam and said left displacement preventing block;

wherein for said each pair of said displacement preventing blocks disposed between said each adjacent pair of said steel beams, said left side surface of said left displacement preventing block is abutted against a right side surface of said web of said left side steel beam, and said right side surface of said right displacement preventing block is abutted against a left side surface of said web of said right side steel beam;

wherein for said each pair of said displacement preventing blocks disposed between said each adjacent pair of said steel beams, said right side surface of said left displacement preventing block and said left side surface of said right displacement preventing block are abutted with each other, such that said steel beams are inhibited from being displaced downward due to a surface pressure and frictional engagement between said right side surface of said left displacement preventing block and said left side surface of said right displacement preventing block;

wherein for said each pair of said displacement preventing blocks disposed between said each adjacent pair of said steel beams, said left displacement preventing block projects rightwardly from said web of said left side steel beam beyond right edges of said upper and lower flanges of said left side steel beam, and said right displacement preventing block projects leftwardly from said web of said right side steel beam beyond left edges of said upper and lower flanges of said right side steel beam, such that an upper gap is formed between said right edge of said upper flange of said left side steel beam and said left edge of said upper flange of said right side steel beam, and such that a lower gap is formed between said right edge of said lower flange of said left side steel beam and said left edge of said lower flange of said right side steel beam;

wherein for said each pair of said displacement preventing blocks disposed between said each adjacent pair of said steel beams, said left displacement preventing block has a height fitted between said upper and lower flanges of said left side steel beam, and said right displacement preventing block has a height fitted between said upper and lower flanges of said right side steel beam, such that said left displacement preventing block and said right displacement preventing block do not have portions disposed in either of said upper and lower gaps;

wherein said plurality of steel beams comprises a leftmost steel beam, a rightmost steel beam, and a plurality of center steel beams disposed between said leftmost steel beam and said rightmost steel beam;

wherein each of said displacement preventing blocks, said leftmost steel beam, said rightmost steel beam and each of said plurality of center steel beams has a through-hole formed therein;

wherein a tightening wire rod extends through said through-holes of said displacement preventing blocks, said leftmost steel beam, said rightmost steel beam and said plurality of center steel beams; and wherein said displacement preventing blocks, said leftmost steel beam, said rightmost steel beam and said plurality of center steel beams are tightened together by said tightening wire rod, such that, for said each pair of said displacement preventing blocks disposed between said each adjacent pair of said steel beams, said right side surface of said left displacement preventing block and said left side surface of said right displacement preventing block are press tightened against each other, and said left side surface of said left displacement preventing block is press tightened against said right side surface of said web of said left side steel beam, and said right side surface of said right displacement preventing block is press tightened against said left side surface of said web of said right side steel beam.

2. A floor structure according to claim 1, wherein said left and right displacement preventing blocks are formed of a wood, or lightweight cellular concrete or rigid foamed resin.

3. A floor structure according to claim 1, wherein for said each pair of said displacement preventing blocks disposed between said each adjacent pair of said steel beams, said left displacement preventing block and said right displacement preventing block are of equal width.

4. A floor structure according to claim 1, wherein for said each pair of said displacement preventing blocks disposed between said each adjacent pair of said steel beams, said left side surface of said right displacement preventing block and said right side surface of said left displacement preventing block surfaces are planar.

5. A floor structure according to claim 1, wherein for said each pair of said displacement preventing blocks disposed between said each adjacent pair of said steel beams, said mutually opposing side surfaces include mutually engaging concave and convex parts or step parts.

6. A floor structure according to claim 1, wherein for said each pair of said displacement preventing blocks disposed between said each adjacent pair of said steel beams, said mutually opposing side surfaces are at least partially curved.

7. A floor structure according to claim 1, wherein for said each pair of said displacement preventing blocks disposed between said each adjacent pair of said steel beams, said left side surface of said right displacement preventing block and said right side surface of said left displacement preventing block surfaces are planar and extend vertically.

8. A floor structure according to claim 7, wherein for said each pair of said displacement preventing blocks disposed between said each adjacent pair of said steel beams, said left side surface of said right displacement preventing block and said right side surface of said left displacement preventing block surfaces are disposed substantially at a center between said web of said left displacement preventing block and said web of said right displacement preventing block.

9. A floor structure according to claim 1, wherein for said each pair of said displacement preventing blocks disposed between said each adjacent pair of said steel beams, said left side surface of said right displacement preventing block and said right side surface of said left displacement preventing block surfaces are disposed substantially at a center between said web of said left displacement preventing block and said web of said right displacement preventing block.

* * * * *